US010992041B2

(12) United States Patent
Syed et al.

(10) Patent No.: US 10,992,041 B2
(45) Date of Patent: Apr. 27, 2021

(54) DUAL-FREQUENCY FEED SOURCE ASSEMBLY AND DUAL-FREQUENCY MICROWAVE ANTENNA

(71) Applicant: Rosenberger Technologies Co., Ltd., Kunshan (CN)

(72) Inventors: Junaid Syed, Kircaldy (GB); Stephen Simms, Larbert (GB)

(73) Assignee: ROSENBERGER TECHNOLOGIES CO., LTD., Kunshan (CN)

( * ) Notice: Subject to any disclaimer, the term of this patent is extended or adjusted under 35 U.S.C. 154(b) by 0 days.

(21) Appl. No.: 16/615,730

(22) PCT Filed: Jun. 12, 2018

(86) PCT No.: PCT/CN2018/090754
§ 371 (c)(1),
(2) Date: Nov. 21, 2019

(87) PCT Pub. No.: WO2019/011096
PCT Pub. Date: Jan. 17, 2019

(65) Prior Publication Data

US 2020/0212573 A1 Jul. 2, 2020

(30) Foreign Application Priority Data

Jul. 11, 2017 (CN) ..... 201710560663.2

(51) Int. Cl.
*H01Q 5/47* (2015.01)
*H01Q 13/02* (2006.01)
(Continued)

(52) U.S. Cl.
CPC ..... *H01Q 5/47* (2015.01); *H01Q 13/02* (2013.01); *H01Q 19/132* (2013.01); *H01Q 19/193* (2013.01)

(58) Field of Classification Search
CPC ..... H01Q 5/47; H01Q 13/02; H01Q 19/132; H01Q 19/193; H01Q 19/19; H01Q 13/00;
(Continued)

(56) References Cited

U.S. PATENT DOCUMENTS 4,819,005 A * 4/1989 Wilkes ..... H01Q 5/47 343/776
5,041,840 A * 8/1991 Cipolla ..... H01Q 19/17 343/725

(Continued)

FOREIGN PATENT DOCUMENTS

WO 9910950 3/1999
WO 2012031426 3/2012

OTHER PUBLICATIONS

Wan, Shasha; International Search Report, predecessor PCT Application No. PCT/CN2018/090754, dated Aug. 4, 2018, ISA: SIPO, Beijing, China.

*Primary Examiner* — Vibol Tan
(74) *Attorney, Agent, or Firm* — Ming Jiang; MM IP Services LLC

(57) ABSTRACT

The present invention discloses a dual-frequency feed-source module and a dual-frequency microwave antenna, wherein the dual-frequency feed-source module mainly comprises two coaxially arranged waveguides, the two waveguides respectively provide microwave energy of two different frequency bands to radiating portions for feeding, so that the antenna can be operated in different frequency bands at the same time. The combination of the two coaxial waveguides, a reflector and other structures can form different microwave antennas such as a feedforward dual-band microwave antenna and a feedback Cassegrain dual-band microwave antenna. The invention feeds microwave energy through the two waveguides, so that the antenna can be
(Continued)

operated in two frequency bands at the same time, thus greatly expanding an application range of the microwave antenna.

11 Claims, 7 Drawing Sheets

(51) Int. Cl.
*H01Q 19/19* (2006.01)
*H01Q 19/13* (2006.01)

(58) Field of Classification Search
CPC ..... H01Q 13/025; H01Q 13/04; H01Q 13/06; H01Q 13/08; H01Q 5/55; H01Q 5/45; H01Q 13/0266; H01Q 15/16; H01Q 13/065; H01Q 1/288
See application file for complete search history.

(56) References Cited

U.S. PATENT DOCUMENTS

| | | | | |
|---|---|---|---|---|
| 6,005,528 | A * | 12/1999 | Preiss | H01Q 13/0208 333/126 |
| 6,081,170 | A * | 6/2000 | Enokuma | H01Q 5/47 333/134 |
| 6,720,932 | B1 * | 4/2004 | Flynn | H01P 1/213 333/21 A |
| 6,985,120 | B2 * | 1/2006 | Lewry | H01Q 1/528 343/781 CA |
| 10,897,084 | B2 * | 1/2021 | Saraf | H01Q 5/392 |
| 2014/0368408 | A1 | 12/2014 | Tuau et al. | |

* cited by examiner

DUAL-FREQUENCY FEED SOURCE ASSEMBLY AND DUAL-FREQUENCY MICROWAVE ANTENNA

TECHNICAL FIELD

The present invention relates to a microwave antenna, and more particularly, to a dual-frequency feed-source module and a dual-frequency microwave antenna operated in two frequency bands.

BACKGROUND ART

In a microwave point-to-point or point-to-multipoint communication network, a microwave antenna is a device for receiving and transmitting an electromagnetic wave signal. The microwave antenna applied in a frequency band ranging from 5 GHz to 80 GHz usually comprises four modules: a feed source, a reflector commonly known as a reflector device, an antenna cover commonly known as a radome, and auxiliary mounting members. The mounting member plays a role of fixing the antenna on a lifting pole or an iron tower; and the radome plays a role of protecting the antenna from an influence of a natural environment such as rain, snow, freezing, etc. Meanwhile, the radome is required to have as little influence on an electrical performance of the antenna as possible. The reflector and the feed source mainly determine the electrical performance of the antenna, and when the antenna is used as a receiving antenna, an electromagnetic wave transmitted from an independent source is reflected and converged by the reflector, then received by the feed source, and transmitted to a receiver through a closed transmission line such as a waveguide and the like; and when the antenna is used as a transmitting antenna, an electromagnetic wave signal transmitted by a signal source is transmitted to the feed source through a closed transmission line such as a waveguide and the like, then radiated by the feed source to illuminate the reflector according to a certain amplitude and a phase distribution requirement, and finally reflected through the reflector to a free space for irradiation. With the development of microwave communication, the market demand for the microwave antenna is increasing, and meanwhile, the performance requirement for the antenna is also increasing. The microwave antenna not only is required to meet strict electrical performance indexes and mechanical performance indexes such as size, weight, wind load and the like, but also is required to have low costs in manufacturing, transportation, mounting and other links.

At present, various technical solutions for realizing an ultra-high performance microwave antenna have been developed, such as a feed source of a microwave antenna and a microwave antenna disclosed in patent document CN201758183U, comprising a feed horn, a support frame and a secondary reflector, wherein the support frame fixes the feed horn and the secondary reflector on the same central axis, the support frame comprises a first connecting portion for connecting the feed horn and a second connecting portion for connecting the secondary reflector, and the first connecting portion and the second connecting portion are fixedly connected by at least one support column. An antenna radiation pattern using the feed source meets an envelope requirement of the ETSIClass3 standard, a structure and a processing technology thereof can ensure the consistency of performance well, and the cost is very low, which is convenient for mass production.

The patent document CN101976766B discloses an ultra-high performance microwave antenna and a feed-source module thereof, wherein the feed-source module has a rotationally symmetrical structure and comprises a secondary reflector, a medium block, a waveguide and a base, one end of the waveguide is inserted into the base, the other end of the waveguide is used for a first end of the medium block to insert, and a second end of the medium block is covered with the secondary reflector according to an end surface shape of the end. A part of the medium block inserted into the waveguide has at least one cylinder; a side surface portion exposed outside the waveguide is provided with a plurality of cylindrical surfaces with different diameters; an end surface of the second end is provided with an inclined conical surface which is centered and concave towards the first end, a circular ring plane is formed along a periphery of the inclined conical surface, and at least one perturbation structure is arranged on the inclined conical surface. The microwave antenna and the feed-source module thereof in the solution have good electrical performance, simple and compact physical structure and relatively low costs.

However, the antenna structure above is only applicable to operation in a single frequency band instead of a dual frequency band, so that an application range is limited to a certain extent.

SUMMARY OF THE INVENTION

The present invention is intended to overcome the defects in the prior art, and provides a dual-frequency feed-source module and a dual-frequency microwave antenna, so that the antenna can be operated in different frequency bands.

In order to achieve the objective above, the present invention provides the following technical solution: a dual-frequency feed-source module comprises a first waveguide, a second waveguide and a secondary reflector, wherein the second waveguide is located in the first waveguide and is coaxially arranged with the first waveguide, the secondary reflector is located outside a terminal opening of the first waveguide and is connected with the first waveguide, and the first waveguide and the second waveguide share the secondary reflector.

Preferably, conical horn mouths are used in terminals of the first waveguide and the second waveguide.

Preferably, the secondary reflector, taking axes of the first and second waveguides as a central axis, is a curved surface formed by rotating for one circle along a circumferential direction of the central axis.

Preferably, the secondary reflector is connected with the first waveguide through a support structure.

The present invention further provides another technical solution: a dual-frequency feed-source module comprises a first waveguide, wherein the first waveguide is internally provided with a second waveguide coaxial with the first waveguide, and tapered antennas are used in terminals of the first waveguide and the second waveguide as feeding structures.

Preferably, conical horn mouths are used in the terminals of the first waveguide and the second waveguide.

Preferably, the first and second waveguides are respectively communicated with a transmission pipeline, and the transmission pipeline is used for receiving or emitting microwave energy.

Preferably, the transmission pipeline is curved and approximately J-shaped.

Preferably, a rectangular waveguide is used in the transmission pipeline.

The present invention further provides another technical solution: a dual-frequency feed-source module comprises a first waveguide, a second waveguide and a medium block, wherein the second waveguide is located in the first waveguide and is coaxially arranged with the first waveguide, a bottom portion of the medium block is inserted into the first waveguide and/or the second waveguide, an upper end surface of the medium block forms a secondary reflector, and the first waveguide and the second waveguide share the secondary reflector.

Preferably, a shape of the secondary reflector is the same as that of the upper end surface of the medium block.

Preferably, terminals of the first and second waveguides have cylindrical openings.

The present invention further provides another technical solution: a dual-frequency microwave antenna comprises a dual-frequency feed-source module and a reflector, wherein the dual-frequency feed-source module is any one of the dual-frequency feed-source modules above.

The present invention has the beneficial effects that: a plurality of microwave antenna structures are formed by arranging two coaxial waveguides according to the present invention, comprising a feedforward type and a feedback type, and a user can select the antenna of corresponding structure according to actual needs; and in addition, the microwave energy is fed through the two waveguides, so that the antenna can be operated in two frequency bands at the same time, for example, one frequency band is used for transmitting a signal and the other frequency band is used for receiving the signal, thus greatly expanding an application range of the microwave antenna.

REFERENCE NUMERALS

1 refers to reflector, 2 refers to first waveguide, 21 refers to tube body of first waveguide, 22 refers to horn mouth of first waveguide, 23 refers to cavity channel of first waveguide, 24 refers to radiating surface of first waveguide, 3 refers to second waveguide, 31 refers to tube body of second waveguide, 32 refers to horn mouth of second waveguide, 33 refers to cavity channel of second waveguide, 34 refers to radiating surface of second waveguide, 4 refers to secondary reflector, 5 refers to secondary reflecting support surface, 6 refers to mounting member, 7 refers to first transmission pipeline, 8 refers to second transmission pipeline, 9 refers to medium block, 91 refers to stepped surface, 4' refers to secondary reflector, 41' refers to first inclined conical surface, and 42' refers to second inclined conical surface.

DETAILED DESCRIPTION OF THE PREFERRED EMBODIMENTS

The technical solutions of the embodiments of the present invention are clearly and completely described hereinafter with reference to the drawings of the present invention.

Figure 1:
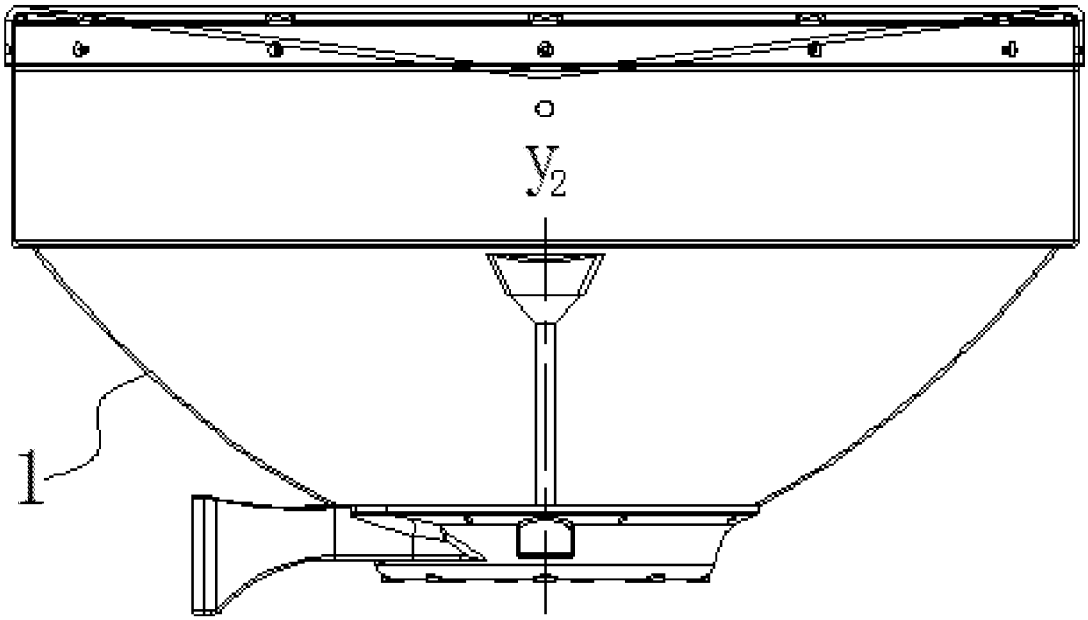
FIG. 1 is a structure diagram of a dual-frequency microwave antenna of the embodiment 1 according to the present invention.
Figure 5:
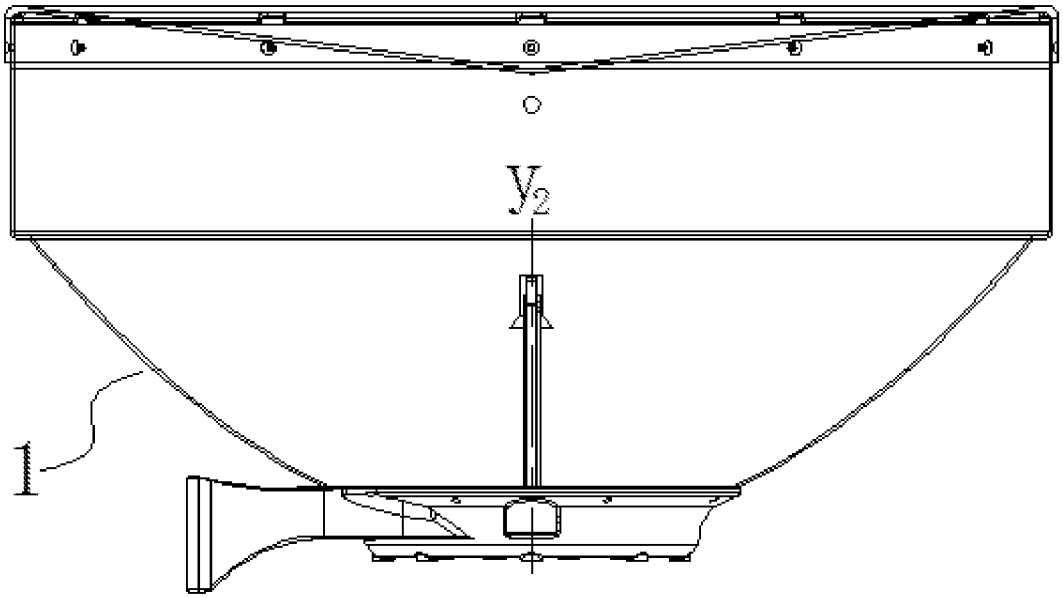
FIG. 5 is a structure diagram of a dual-frequency microwave antenna of the embodiment 2 according to the present invention.
Figure 7:
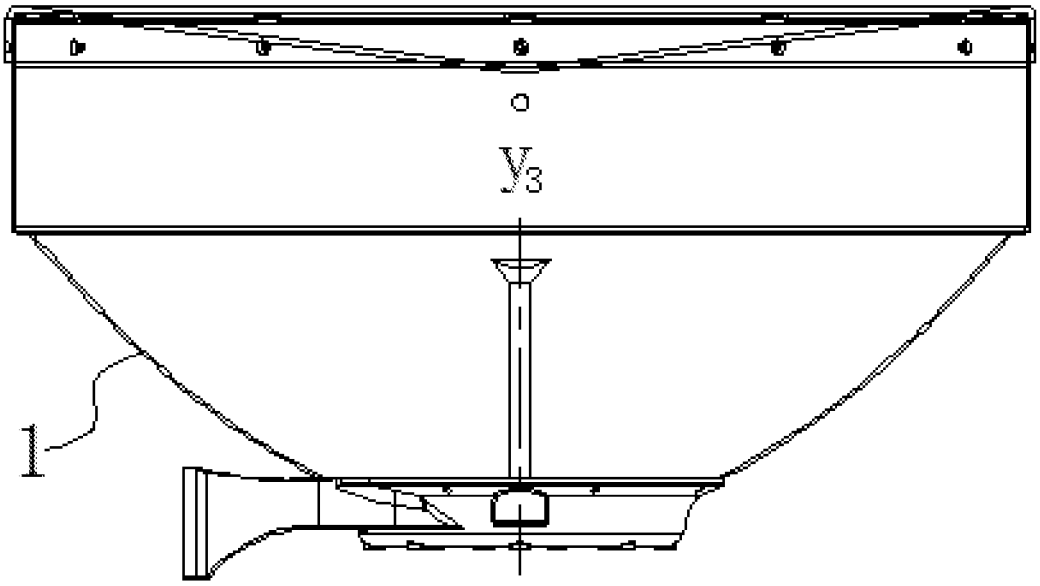
FIG. 7 is a structure diagram of a dual-frequency microwave antenna of the embodiment 3 according to the present invention.

A dual-frequency microwave antenna disclosed by the present invention can be operated in two different frequency bands (such as an E-band and a K-band) at the same time. As shown in FIG. 1, FIG. 5 and FIG. 7, the dual-frequency microwave antenna comprises a dual-frequency feed-source module and a reflector 1, wherein the reflector 1 is paraboloid in shape and symmetrical along an axis of the reflector 1 (that is, an axis y1, y2 or y3 hereinafter). When the antenna is in a transmitting state, an electromagnetic signal generated by a transmitter is transmitted and radiated to the reflector 1 through the dual-frequency feed-source module, and finally radiated to a free space from the reflector 1; and a working principle of the antenna in a receiving state is opposite to the antenna in the transmitting state: an electromagnetic wave incident on the antenna is reflected to the dual-frequency feed-source module through the reflector 1, and finally received by the dual-frequency feed-source module and inputted to a receiver.

The dual-frequency feed-source module mainly comprises two coaxially arranged waveguides, and the two waveguides respectively provide energy of two different frequency bands to radiating portions for feeding, so that the antenna can be operated in different frequency bands at the same time. The combination of the two coaxial waveguides, the reflector 1 and other structures can form multiple types of microwave antennas such as a feedforward dual-band microwave antenna, a feedback parabolic dual-frequency microwave antenna, a feedback conical dual-frequency microwave antenna and the like. A structure of the dual-frequency feed-source module of the present invention is described in detail hereinafter with several specific embodiments of the dual-frequency feed-source module.

Embodiment 1

Figure 2:
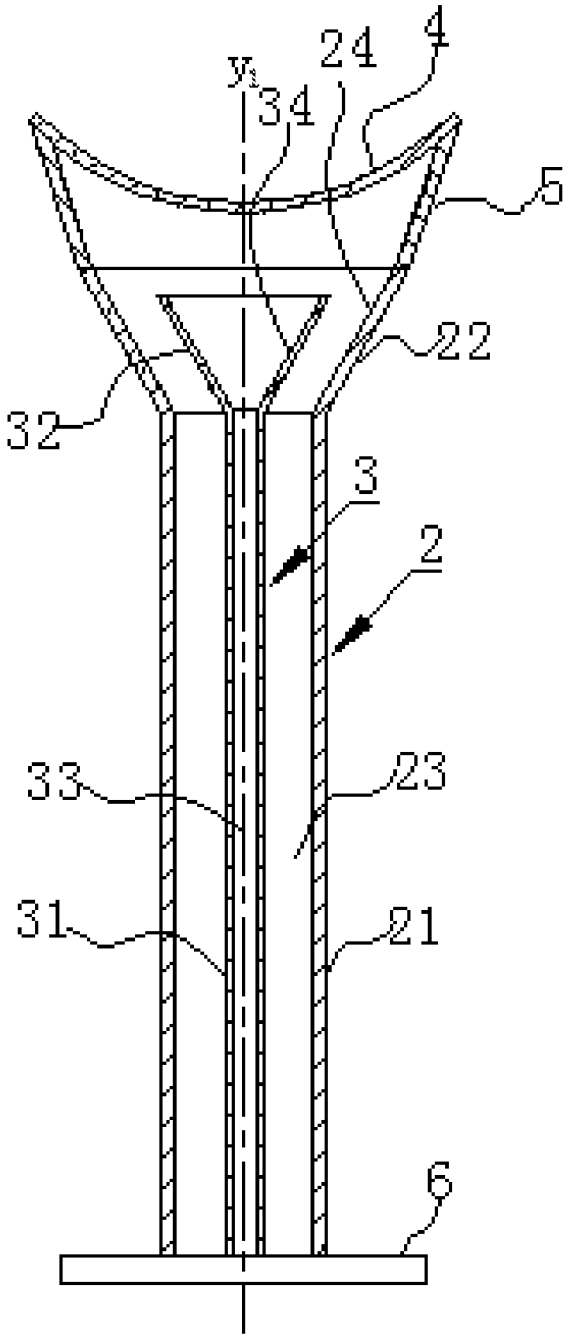
FIG. 2 is a structure diagram of a dual-frequency feed-source module in FIG. 1.

As shown in FIG. 1 and FIG. 2, as the most preferred embodiment of the present invention, a dual-frequency feed-source module disclosed in the embodiment 1 of the present invention comprises a first waveguide 2, a second waveguide 3 and a secondary reflector 4, wherein the second waveguide 3 is located in the first waveguide 2 and is coaxially arranged with the first waveguide 2, that is, the first waveguide 2 and the second waveguide 3 have the same rotational axis of symmetry labeled as an axis y1.

The first waveguide 2 and the second waveguide 3 are both composed of cylindrical tube bodies 21 and 31 and horn mouths 22 and 32 formed by gradual outward expansion of terminals of the tube bodies, cavity channels 23 and 33 for transmitting microwave energy are formed in the tube bodies 21 and 31, inner walls of the horn mouths 22 and 32 form radiating surfaces 24 and 34 of the microwave energy, and the electromagnetic wave is transmitted to the horn mouths 22 and 32 through the cavity channels 23 and 33 in the tube bodies 21 and 31 of the waveguides 2 and 3, and radiated by the radiating surfaces 24 and 34 of the inner walls of the horn mouths 22 and 32. The first waveguide 2 and the second waveguide 3 play a role of primary radiation source herein. In the embodiment 1, the horn mouths 22 and 32 of the two waveguides 2 and 3 are conical, and the two horn mouths 22 and 32 are both opened upwardly.

A certain gap exists between the second waveguide 3 and the first waveguide 2 to form the cavity channel 23 for transmitting the microwave energy of the first waveguide.

The secondary reflector 4 is located above the horn mouths 22 and 32 of the two waveguides and is connected with the first horn mouth 22. Specifically, the secondary reflector 4 and the first horn mouth 22 are connected through a support surface 5 located between the secondary reflector 4 and the first horn mouth 22, the support surface 5 connects an outermost bottom end of the secondary reflector 4 and an upper end of the horn mouth 22 of the first waveguide 2. In the embodiment 1, the secondary reflector 4, taking the axis y1 as a central axis, is a curved surface formed by rotating for one circle along a circumferential direction of the central axis; and the support surface 5 is also a gradually flared surface, and a taper angle formed by the surface is smaller than that formed by the first horn mouth 22. Certainly, a shape of the support surface 5 is not limited to a horn surface defined herein, and other shapes are also applicable to the present invention as long as connection between the secondary reflector 4 and the first horn mouth 22 can be realized. In addition, the secondary reflector 4 is directly connected with the first horn mouth 22, that is, a structure in which no support surface 5 is arranged between the secondary reflector 4 and first horn mouth 22 is also applicable to the present invention. The microwave energy radiated from the horn mouths 22 and 32 of the two waveguides is reflected to the reflector 1 (that is, the main reflector) through the secondary reflector 4, and finally radiated to the free space from the main reflector 1.

Further, in the embodiment 1, one ends of the two waveguides 2 and 3 opposite to the terminals are both connected with a mounting member 6, and the entire feed-source module can be mounted on a reflecting member providing the reflector 1 through the mounting member 6. In the embodiment 1, both the entire feed-source module and the reflector 1 are rotationally symmetrical along the axis y1.

The embodiment 1 can be applied to Cassegrain antenna configuration, and an antenna structure formed in the embodiment 1 not only can be operated in two different frequency bands, but also can obtain a minimum influence on an antenna radiation pattern and a gain compared with the feedforward microwave antenna, thus improving an efficiency of the antenna.

Embodiment 2

Figure 3:
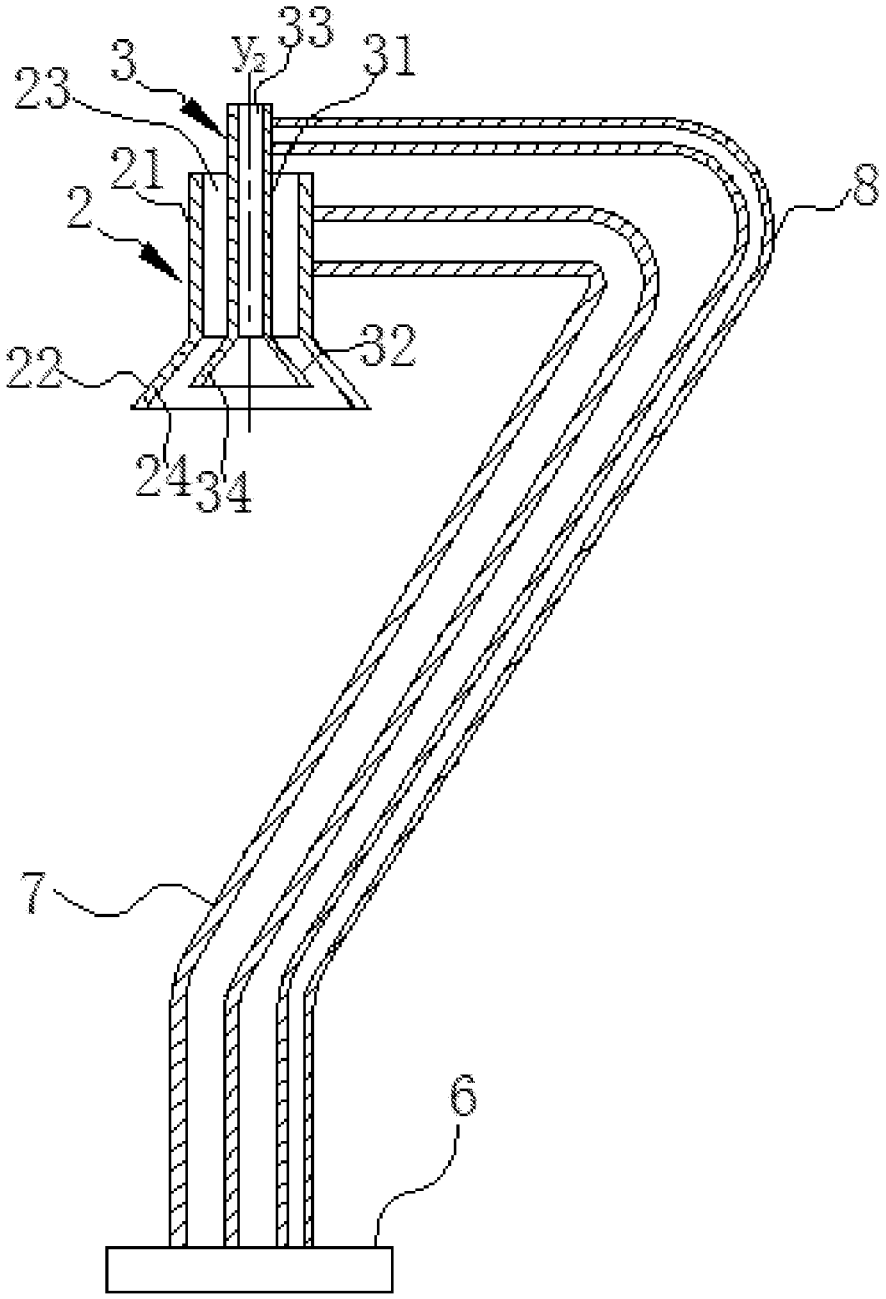
FIG. 3 is a structure diagram of a dual-frequency feed-source module of the embodiment 2 according to the present invention.
Figure 4:
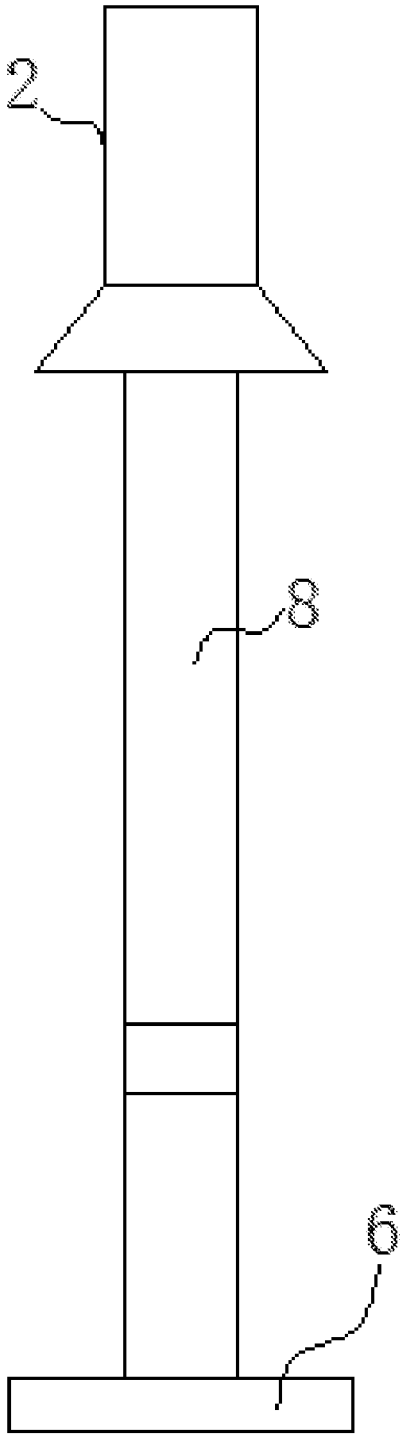
FIG. 4 is a side view of a structure of the dual-frequency feed-source module of the embodiment 2 according to the present invention.

As shown in FIG. 3 to FIG. 5, a dual-frequency feed-source module disclosed in the embodiment 2 of the present invention comprises a first waveguide 2 and a second waveguide 3, wherein the second waveguide 3 is located in the first waveguide 2 and is coaxially arranged with the first waveguide 2, that is, the first waveguide 2 and the second waveguide 3 have the same rotational axis of symmetry labeled as an axis y2.

Tapered antennas are used in terminals of the first waveguide 2 and the second waveguide 3 as feeding structures. The first waveguide 2 and the second waveguide 3 are both composed of cylindrical tube bodies 21 and 31 and horn mouths 22 and 32 formed by gradual outward expansion of terminals of the tube bodies, cavity channels 23 and 33 for transmitting microwave energy are formed in the tube bodies 21 and 31, inner walls of the horn mouths 22 and 32 form radiating surfaces 24 and 34 of the microwave energy, and the electromagnetic wave is transmitted to the horn mouths 22 and 32 through the cavity channels 23 and 33 in the tube bodies 21 and 31 of the waveguides 2 and 3, and radiated by the radiating surfaces 24 and 34 of the inner walls of the horn mouths 22 and 32. The first waveguide 2 and the second waveguide 3 play a role of primary radiation source herein. In the embodiment 2, the horn mouths 22 and 32 of the two waveguides 2 and 3 are both conical, and the two horn mouths are both opened downwardly, that is, facing the reflector.

In addition, the first waveguide 2 and the second waveguide 3 are respectively communicated with a transmission pipeline, and the first waveguide 2 and the second waveguide 3 receive or emit microwave energy through the transmission pipelines. For convenience of description, the transmission pipeline corresponding to the first waveguide 2 is defined as a first transmission pipeline 7, and the transmission pipeline corresponding to the second waveguide 3 is defined as a second transmission pipeline 8. One ends of the first and second transmission pipelines 7 and 8 are communicated with the tube bodies 21 and 31 of the waveguides, the other ends are both connected with a mounting member 6, and the entire feed-source module of the embodiment 2 can be mounted on a reflecting member providing the reflector 1 through the mounting member 6. The microwave energy radiated from the horn mouths 22 and 32 of the two waveguides is directly radiated to the reflector 1, and finally radiated to a free space from the reflector 1.

In the embodiment 2, the first and second transmission pipelines 7 and 8 are both curved and approximately J-shaped. Certainly, the shapes are not limited to the J-shaped curved shape defined herein, and other shapes are also applicable to the present invention. For example, a rectangular waveguide with a rectangular cross section can be used as long as support connection between the waveguide and the reflector 1 is realized.

The microwave antenna formed in the embodiment 2 is a feedforward type, and can be operated in two different frequency bands as the antenna structure formed in the embodiment 1, and compared with the antenna structure formed in the embodiment 1, the microwave antenna is relatively simple in electrical design. However, since the horn mouth of the waveguide is not applicable to providing energy when a bending angle is greater than 180 degrees, energy is not applicable to being effectively radiated to an edge of a deep reflector (a focal diameter ratio is usually $F/D<0.25$), that is, the solution of the embodiment 2 is more applicable to a shallow reflector (a focal diameter ratio is usually $F/D>0.25$).

Embodiment 3

Figure 6:
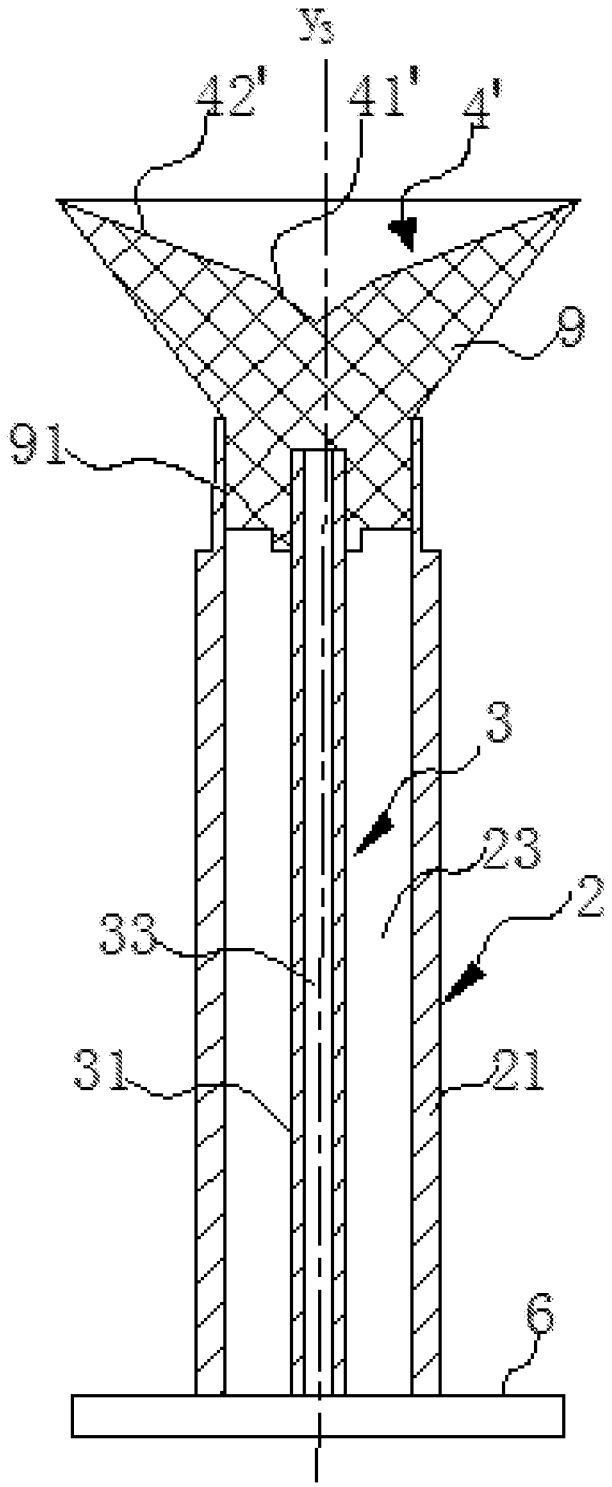
FIG. 6 is a structure diagram of a dual-frequency feed-source module of the embodiment 3 according to the present invention.

As shown in FIG. 6 and FIG. 7, a dual-frequency feed-source module disclosed in the embodiment 3 of the present invention comprises a first waveguide 2, a second waveguide 3 and a medium block 9, wherein the second waveguide 3 is located in the first waveguide 2 and is coaxially arranged with the first waveguide 2, that is, the first waveguide 2 and the second waveguide 3 have the same rotational axis of symmetry labeled as an axis y3.

An upper end surface of the medium block 9 forms a secondary reflector 4', a bottom portion of the medium block 9 is inserted into a tube body 21 of a terminal of the first waveguide 2 and/or a tube body 31 of a terminal of the second waveguide 3, and the first waveguide 2 and the second waveguide 3 share the secondary reflector 4'. In the embodiment 3, the entire medium block 9 is rotationally symmetrical along the axis y3, and a shape of the secondary reflector 4' is the same as that of the upper end surface of the medium block 9. Specifically, the secondary reflector 4' comprises a first inclined to conical surface 41' and a second inclined conical surface 42', wherein the first inclined conical surface 41' is arranged close to the axis y3 and formed by recessing towards the bottom portion of the medium block 9, and the second inclined conical surface 42' is located on two outer sides of the first inclined conical surface 41'. In the embodiment 3, the first inclined conical surface 41' and the second inclined conical surface 42' are also rotationally symmetrical along the axis y3. Certainly, a shape of the secondary reflector 4' is not limited to the shape structure defined herein comprising the first inclined conical surface 41' and the second inclined conical surface 42', and other structures that can enable the overall shape of the secondary reflector 4' to be conical are also applicable to the present invention.

An outside surface of a part of the medium block 9 inserted into the first waveguide 2 is a stepped surface with at least one step, wherein in the embodiment 3, an outer surface 91 of the stepped surface closest to an opening of the first waveguide 2 is closely attached to an inner wall of the first waveguide 2, and an outer diameter of the rest stepped surfaces is smaller than an inner diameter of the first waveguide 2; and an outside surface of a part of the medium block 9 exposed outside the first waveguide 2 is conical.

The first waveguide 2 and the second waveguide 3 are both cylindrical tube bodies 21 and 31, cavity channels 23 and 33 for transmitting microwave energy are formed in the tube bodies 21 and 31, a terminal of the second waveguide 3 is inserted into the bottom portion of the medium block 9. The electromagnetic wave is transmitted to the medium block 9 through the cavity channels 23 and 33 in the tube bodies of the waveguides, and radiated from the upper end surface of the medium block 9. The first waveguide 2 and the second waveguide 3 play a role of primary radiation source herein. Microwave energy of the upper end surface of the medium block 9 is reflected to the reflector 1 (that is, the main reflector) through the secondary reflector 4', and finally radiated to a free space from the main reflector 1. In the embodiment 1, terminals of the two waveguides 2 and 3 are both opened upwardly.

Further, in the embodiment 3, one ends of the two waveguides 2 and 3 opposite to the terminals are both connected with a mounting member 6, and the entire feed-source module can be mounted on a reflecting member providing the reflector through the mounting member 6. In the embodiment 3, both the entire feed-source module and the reflector 1 are rotationally symmetrical along the axis y3.

The antenna structure formed in the embodiment 3 of the present invention is also a feedback dual-frequency microwave antenna, that is, compared with the antenna structure formed in the embodiment 2, the microwave antenna not only can be operated in two different frequency bands, but also can obtain a minimum influence on an antenna radiation pattern and a gain, thus improving an efficiency of the antenna. However, since a diameter of the secondary reflector is too large and a low-band performance is required, reducing the diameter of the secondary reflector can prevent excessive blocking of energy of an E-band during design.

The above discloses the technical contents and technical features of the present invention, but those skilled in the art can still make various replacements and modifications without deviating from the spirit of the present invention based on the instruction and disclosure of the present invention. Therefore, the protection scope of the present invention are limited to the contents disclosed by the embodiments, but shall include various replacements and modifications without deviating from the present invention, and shall be covered by the claims of the patent application.

The invention claimed is:

1. A dual-frequency feed-source module, comprising:

a first waveguide;

a second waveguide coaxially positioned inside of the first waveguide; and a secondary reflector, wherein the secondary reflector is attached to a terminal opening outside of the first waveguide, wherein the first waveguide and the second waveguide share the secondary reflector, and the secondary reflector receives and emits microwave energy through a primary reflector.

2. The dual-frequency feed-source module according to claim 1, wherein conical horn mouths are used in terminals of the first waveguide and the second waveguide.

3. The dual-frequency feed-source module according to claim 1, wherein the secondary reflector, taking axes of the first and second waveguides as a central axis, is a curved surface formed by rotating for one circle along a circumferential direction of the central axis.

4. A dual-frequency feed-source module, comprising: a first waveguide, wherein the first waveguide is internally provided with a second waveguide coaxial with the first waveguide, and a first horn mouth and a second horn mouth are attached to terminals of the first waveguide and the second waveguide respectively, and the first horn mouth and the second horn mouth face inward towards a primary reflector, and receive and emit microwave energy through the primary reflector.

5. The dual-frequency feed-source module according to claim 4, wherein conical horn mouths are used in the terminals of the first waveguide and the second waveguide.

6. The dual-frequency feed-source module according to claim 4, wherein the first waveguide communicates with a first transmission pipeline and the second waveguide communicates with a second transmission pipeline, and each of the first transmission pipeline and the second transmission pipeline is used for receiving and emitting microwave energy.

7. A dual-frequency feed-source module, comprising:

a first waveguide;

a second waveguide coaxially positioned inside of the first waveguide; and a medium block, wherein a bottom portion of the medium block is inserted in the first waveguide and the second waveguide, and an upper portion surface of the medium block forms a secondary reflector, wherein the first waveguide and the second waveguide share the secondary reflector, and the secondary reflector receives and emits microwave energy through a primary reflector.

8. The dual-frequency feed-source module according to claim 7, wherein terminals of the first and second waveguides have cylindrical openings.

9. A dual-frequency microwave antenna, comprising a dual-frequency feed-source module according to claim 7 and the primary reflector.

10. A dual-frequency microwave antenna, comprising a dual-frequency feed-source module according claim 1 and the primary reflector.

11. A dual-frequency microwave antenna, comprising a dual-frequency feed-source module according claim 4 and the reflector.

* * * * *